US012030604B2

(12) United States Patent
Jonsson et al.

(10) Patent No.: US 12,030,604 B2
(45) Date of Patent: Jul. 9, 2024

(54) PROPELLER FOR A MARINE VESSEL

(71) Applicant: VOLVO PENTA CORPORATION, Gothenburg (SE)

(72) Inventors: Kåre Jonsson, Trollhättan (SE); Oddbjörn Hallenstvedt, Valskog (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 97 days.

(21) Appl. No.: 17/753,154

(22) PCT Filed: Sep. 18, 2020

(86) PCT No.: PCT/EP2020/076088
§ 371 (c)(1),
(2) Date: Feb. 22, 2022

(87) PCT Pub. No.: WO2021/058388
PCT Pub. Date: Apr. 1, 2021

(65) Prior Publication Data

US 2022/0274678 A1 Sep. 1, 2022

(30) Foreign Application Priority Data

Sep. 23, 2019 (SE) ..... 1951067-6

(51) Int. Cl.
*B63H 1/26* (2006.01)
*B63H 1/18* (2006.01)
*B63H 5/10* (2006.01)

(52) U.S. Cl.
CPC ..... *B63H 1/26* (2013.01); *B63H 1/18* (2013.01); *B63H 5/10* (2013.01)

(58) Field of Classification Search
CPC ..... B63H 1/18; B63H 1/26; B63H 5/10
See application file for complete search history.

(56) References Cited

U.S. PATENT DOCUMENTS 2,350,942 A * 6/1944 Tarn ..... B63H 5/10 416/198 R
4,150,914 A 4/1979 Karlsson
(Continued)

FOREIGN PATENT DOCUMENTS

CN 105452100 A 3/2016
CN 107108004 A 8/2017
(Continued)

OTHER PUBLICATIONS

KR-20120029914-A (Mar. 2012) (Lee et al.) English Translation (Year: 2023).*
(Continued)

*Primary Examiner* — David E Sosnowski
*Assistant Examiner* — Aye S Htay
(74) *Attorney, Agent, or Firm* — Venable LLP; Jeffri A. Kaminski

(57) ABSTRACT

A propeller (20) for a marine vessel (10), the propeller (20) comprising a plurality of propeller blades (24, 26). The propeller blades comprise a leading edge (30), a trailing edge (32) and an outer edge (34) located between the leading edge and the trailing edge. A transition from the leading edge to the outer edge occurs at a first transition point (36) and a transition from the outer edge to the trailing edge occurs at a second transition point (38). A straight line from the first transition point to the second transition point coincides with the outer edge (34) or is located at least partially outside the propeller blade. A smallest distance ($D_2$) from the second transition point to the axis of rotation (A) is smaller than a smallest distance ($D_1$) from the first transition point to the axis of rotation.

10 Claims, 3 Drawing Sheets

(56) References Cited

U.S. PATENT DOCUMENTS

| | | | | | |
|---|---|---|---|---|---|
| 4,293,280 | A | | 10/1981 | Yim | |
| 5,632,658 | A | * | 5/1997 | Chen | B63H 5/10 114/65 R |
| 5,800,223 | A | * | 9/1998 | Iriono | F02B 61/045 440/49 |
| 5,820,425 | A | * | 10/1998 | Ogino | B63H 5/10 440/78 |
| 6,371,726 | B1 | | 4/2002 | Jonsson et al. | |
| 7,517,263 | B1 | | 4/2009 | Shen et al. | |
| 8,951,018 | B1 | | 2/2015 | Calamia et al. | |
| 2007/0098559 | A1 | * | 5/2007 | Hedlund | B63H 5/10 416/198 R |
| 2013/0045107 | A1 | | 2/2013 | Topaz et al. | |
| 2014/0161622 | A1 | | 6/2014 | Sharrow | |
| 2015/0203181 | A1 | | 7/2015 | Chapple et al. | |

FOREIGN PATENT DOCUMENTS

| | | | | |
|---|---|---|---|---|
| CN | 108430868 | A | | 8/2018 |
| CN | 101626950 | A | | 1/2020 |
| EP | 2885203 | A1 | | 6/2015 |
| FR | 2403478 | A1 | | 4/1979 |
| GB | 460765 | A | | 2/1937 |
| KR | 20120029914 | A | * | 3/2012 |
| KR | 20140045660 | A | | 4/2014 |
| KR | 20160024021 | A | | 3/2016 |
| RU | 2117602 | C1 | | 8/1998 |
| WO | 2012050441 | A1 | | 4/2012 |
| WO | 2018075216 | A1 | | 4/2018 |

OTHER PUBLICATIONS

International Search Report and Written Opinion dated Jan. 15, 2021 in corresponding International PCT Application No. PCT/EP2020/076088, 11 pages.

International Preliminary Report on Patentability dated Jun. 16, 2021 in corresponding International PCT Application No. PCT/EP2020/076088, 15 pages.

Chinese Office Action dated May 18, 2023 in corresponding Chinese Patent Application No. 202080057975.1, 11 pages.

* cited by examiner

PROPELLER FOR A MARINE VESSEL

CROSS-REFERENCE TO RELATED APPLICATIONS

This application is a U.S. National Stage application of PCT/EP2020/076088, filed Sep. 18, 2020 and published on Apr. 1, 2021, as WO 2021/058388 A1, which claims priority to Sweden Patent Application No. 1951067-6, filed Sep. 23, 2019, all of which is hereby incorporated by reference in its entirety.

TECHNICAL FIELD

The present invention relates to a propeller according to the preamble of claim 1. Moreover, the present invention relates to a propeller combination as well as a marine vessel.

The invention can be used in marine propulsion applications. Although the invention will be described with respect to a boat, the invention is not restricted to this particular marine vessel, but may also be used in other marine vessels such as ships, submarines etcetera. Furthermore, the invention can be used in applications not necessarily related to marine propulsion.

BACKGROUND OF THE INVENTION

A propeller assembly comprising one or more propellers is commonly used for propelling a marine vessel, such as a boat. A propeller rotating around and axis of rotation may generate a so called slip stream extending downstream the propeller. The slip stream may have the shape of a cone the envelope surface of which may follow a parabolic function, as seen along a side plane view of the propeller in a plane that extends parallel to the axis of rotation.

Such a slip stream may cause undesired effects, such as cavitation effects of the propeller generating the slip stream and/or cavitation effects of a further propeller located downstream the slip stream generating propeller.

In order to mitigate such cavitation effects, US 2007/0098559 A1 proposes that a downstream propeller may have a diameter being smaller than the diameter of an upstream propeller in order to ensure that the envelope of the downstream propeller is located within a slip stream cone generated by the upstream propeller. Moreover, US 2007/0098559 A1 proposes that the upstream propeller be furnished with outer edges extending parallel to an axis of rotation of the propellers.

Although the propeller combination proposed by US 2007/0098559 A1 may be very useful in many applications, there is still a need for improving propellers for a marine vessel.

SUMMARY OF THE INVENTION

An object of a first aspect of the present invention is to provide a propeller that can produce an adequate propulsion force but at the same time is associated with a relatively low risk of cavitation problems.

The object is achieved by a propeller according to claim 1.

As such, the first aspect of the present invention relates to a propeller for a marine vessel. The propeller comprises a plurality of propeller blades. The propeller is adapted to be rotated around an axis of rotation.

Each one of the propeller blades comprises an edge that in turn comprises a leading edge, a trailing edge and an outer edge located between the leading edge and the trailing edge, as seen along the edge of the propeller blade. A transition from the leading edge to the outer edge occurs at a first transition point and a transition from the outer edge to the trailing edge occurs at a second transition point.

As seen in a side plane view of the propeller blade in a plane that extends parallel to the axis of rotation, a straight line from the first transition point to the second transition point coincides with the outer edge or is located at least partially outside the propeller blade.

According to the first aspect of the present invention, a smallest distance from the second transition point to the axis of rotation is smaller than a smallest distance from the first transition point to the axis of rotation, and wherein, as seen in said side plane view of said propeller blade, a length of said outer edge along said axis of rotation is equal to or greater than 20% of the maximum length of the propeller blade along said axis of rotation, where each of the transition points is arranged at ends of the outer edge where the extension of the outer edge does not coincide with the straight line and where the edge bends off towards said axis of rotation forming one of said leading edge or said trailing edge, when seen in said plane.

This means that if the outer edge follows the straight line this would result in that the outer edge follows a section of an envelope of an imaginary cone when the propeller rotates. If the straight line from said first transition point to said second transition point is located at least partially outside the outer edge, then this would mean that the outer edge follows an envelope surface when the propeller rotates that may follow a parabolic function.

By virtue of the fact that the smallest distance from the second transition point to the axis of rotation is smaller than a smallest distance from the first transition point to the axis of rotation, the risk of a portion of the outer edge experiencing undesired cavitation phenomena, for instance due to a slip stream induced by the propeller itself or another propeller located upstream the propeller concerned, is reduced.

Optionally, the first transition point is the outermost point, as seen in a radial direction from the axis of rotation, of the propeller blade. Consequently, the outer edge extends out to the radial outermost portion of the propeller blade, thus further reducing the risk of cavitation issues.

Optionally, the first and the second transition points are corners with a curvature radius smaller than 1/10 of a diameter of the propeller, or preferably smaller than 1/50 of a diameter of the propeller. In this way two relatively sharp transition points are arranged in order to provide an outer edge that is clearly distinct from the leading edge and the trailing edge, in order to be able to reduce the risk of cavitation issues.

A length equal to or greater than 20% of maximum length of the propeller blade along said axis of rotation implies that a relatively large portion of the propeller blade may form a part of the outer edge, thus implying that an appropriate propulsion effect may be obtained from the propeller.

Optionally, as seen in the side plane view of the propeller blade, the length of the outer edge along the axis of rotation is equal to or less than 50% of the maximum length of the propeller blade along the axis of rotation. A length equal to or less than 50% implies that a relatively large portion of the propeller blade may be designed with a focus on the propulsion effect rather than cavitation avoidance.

Optionally, as seen in the side plane view of the propeller blade, the length of the outer edge along the axis of rotation is equal to or less than 40% of the maximum length of the propeller blade along the axis of rotation. A length equal to or less than 40% implies that a relatively large portion of the propeller blade may be designed with a focus on the propulsion effect rather than cavitation avoidance.

Optionally, the smallest distance from the second transition point to the axis of rotation is equal to or less than 99% of the smallest distance from the first transition point to the axis of rotation. A smallest relative distance as defined above implies a reduced risk for a portion of the outer edge adjacent to the second transition point to encounter cavitation related effects.

Optionally, the smallest distance from the second transition point to the axis of rotation is equal to or less than 95% of the smallest distance from the first transition point to the axis of rotation. A smallest relative distance as defined above implies a reduced risk for a portion of the outer edge adjacent to the second transition point to encounter cavitation related effects.

Optionally, the smallest distance from the second transition point to the axis of rotation is equal to or greater than 70% of the smallest distance from the first transition point to the axis of rotation. A smallest relative distance as defined above implies that an appropriate propulsion effect may be obtained from the propeller.

Optionally, the smallest distance from the second transition point to the axis of rotation is equal to or greater than 75% of the smallest distance from the first transition point to the axis of rotation. A smallest relative distance as defined above implies that an appropriate propulsion effect may be obtained from the propeller.

A second aspect of the present invention relates to a propeller combination comprising a forward propeller and an after propeller, the propellers are adapted to rotate in opposite directions around the axis of rotation, at least one of the forward propeller and the after propeller being a propeller according to the first aspect of the present invention.

Optionally, each one of the forward propeller and the after propeller is a propeller according to the first aspect of the present invention.

Optionally, the smallest distance from the first transition point to the axis of rotation for the after propeller is smaller than a smallest distance from the second transition point to the axis of rotation for the forward propeller.

A third aspect of the present invention relates to a marine vessel comprising a propeller according to the first aspect of the present invention and/or a propeller combination according to the second aspect of the present invention.

BRIEF DESCRIPTION OF THE DRAWINGS

With reference to the appended drawings, below follows a more detailed description of embodiments of the invention cited as examples.

In the drawings.

DETAILED DESCRIPTION OF PREFERRED EMBODIMENTS

The invention will be described below for a marine vessel in the form of a boat 10 such as the boat illustrated in FIG. 1. The boat 10 should be seen as an example of a marine vessel which could comprise a propeller and/or propeller combination according to the present invention. However, the present invention may be implemented in a plurality of different types of marine vessels. Purely by way of example, the present invention could be implemented in a ship, a submarine or in a thruster intended for a semisubmersible unit.

Figure 1:
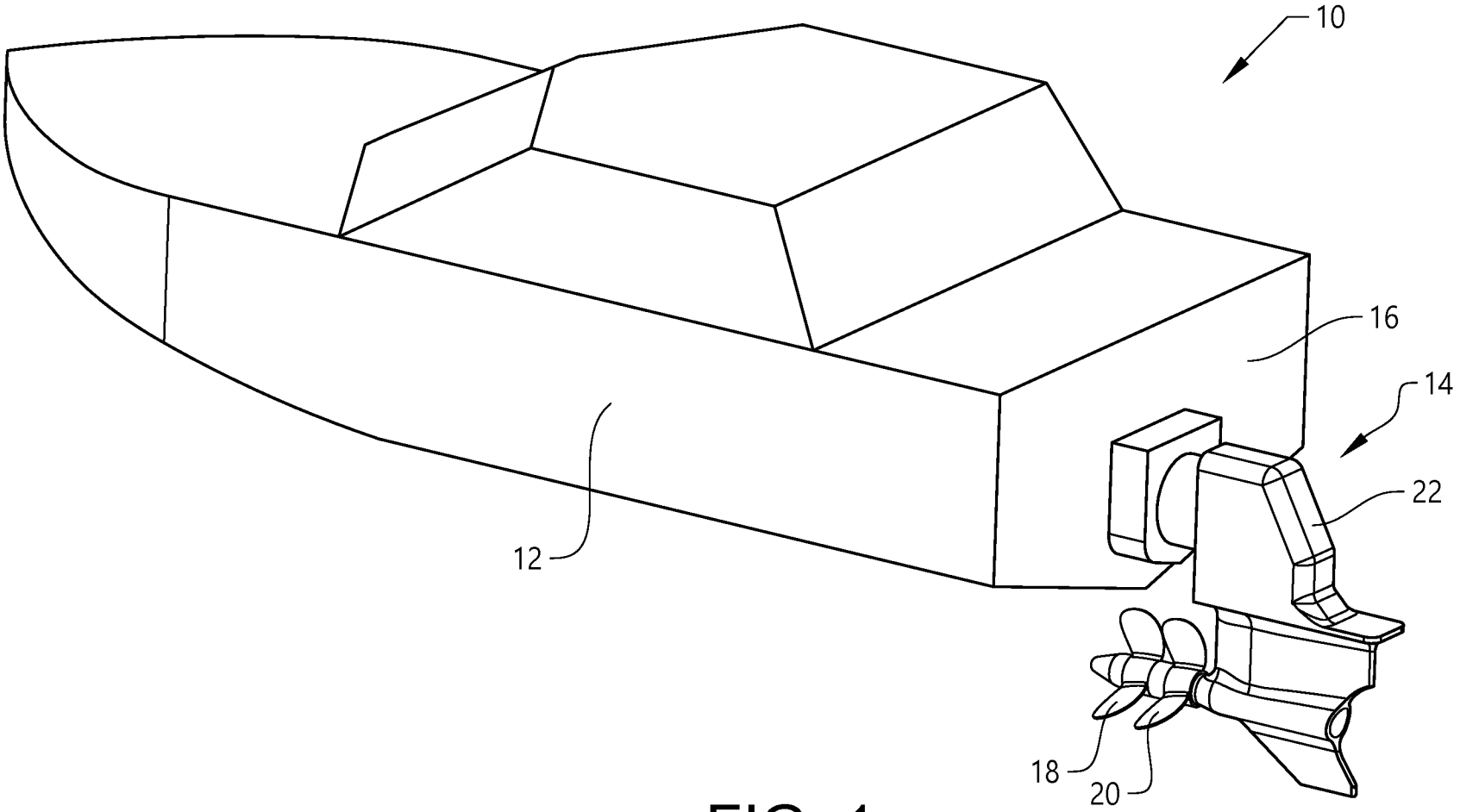
FIG. 1 is a schematic perspective view of a marine vessel.

The FIG. 1 boat 10 comprises a hull 12 and tractor-type drive 14. The drive 14 illustrated in FIG. 1 is configured to be mounted to the stern 16 of the hull 12 but it is also contemplated that other implementations of the drive may be configured to be mounted to other portions of a hull. The drive 14 includes at least one pulling (or tractor) propeller, which can be configured as a propeller combination, comprising a forward propeller 18 and an after propeller 20, mounted to a front end of a gear case 22. The forward and after propellers 18, 20 in the illustrated embodiment are a pair of counter-rotating propellers mounted on coaxially rotating shafts. However, it is also envisaged that the present invention can be applied for a single propeller. Furthermore, it is envisaged that the present invention can be applied for a pushing single propeller or a pushing propeller combination.

Figure 2:
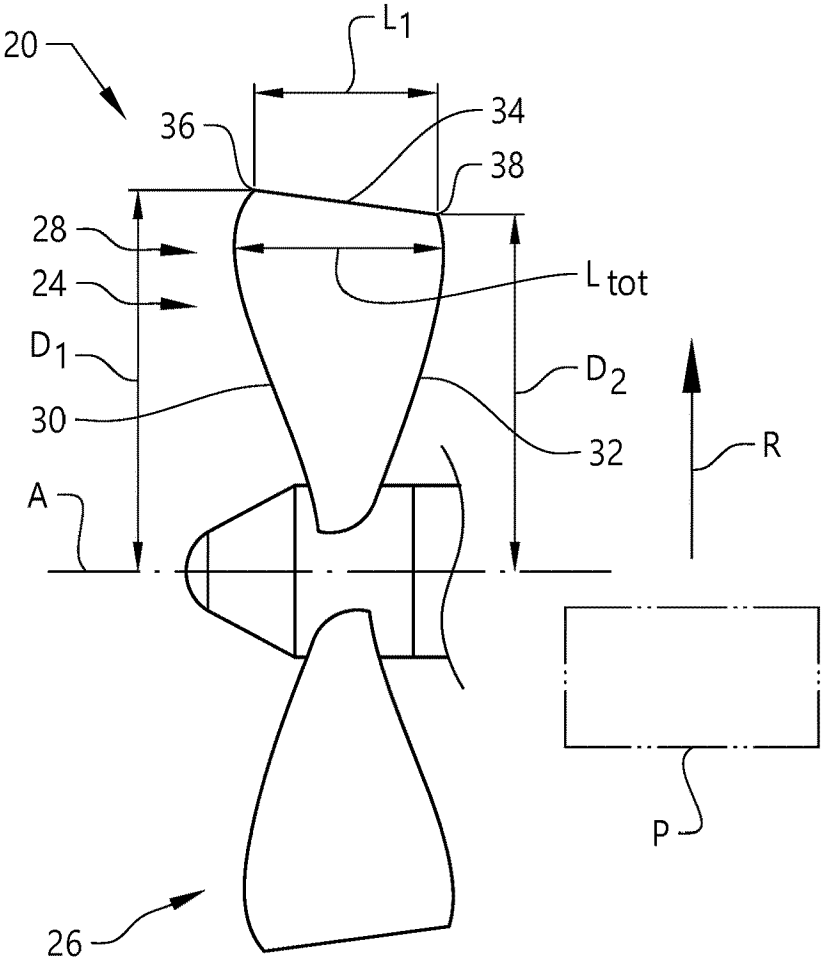
FIG. 2 is a schematic illustration of an embodiment of a propeller.

FIG. 2 illustrates an embodiment of a propeller 20 according to the first aspect of the present invention. Purely by way of example, the FIG. 2 propeller 20 may be adapted to form part of a pulling (or tractor) propeller or propeller combination, such as the FIG. 1 propeller combination, or a pushing propeller or propeller combination.

Irrespective of the intended use of the propeller 20, the propeller 20 comprises a plurality of propeller blades 24, 26. In the FIG. 2 view, two propeller blades are visible but it is contemplated that embodiments of the propeller may comprise at least three propeller blades. The propeller 20 is adapted to be rotated around an axis of rotation A.

With reference to one 24 of the FIG. 2 propeller blades 24, 26, each one of the propeller blades 24, 26 comprises an edge 28 that in turn comprises a leading edge 30, a trailing edge 32 and an outer edge 34 located between the leading edge 30 and the trailing edge 32, as seen along the edge 28 of the propeller blade 24. A transition from the leading edge 30 to the outer edge 34 occurs at a first transition point 36 and a transition from the outer edge 34 to the trailing edge 32 occurs at a second transition point 38.

Figure 3:
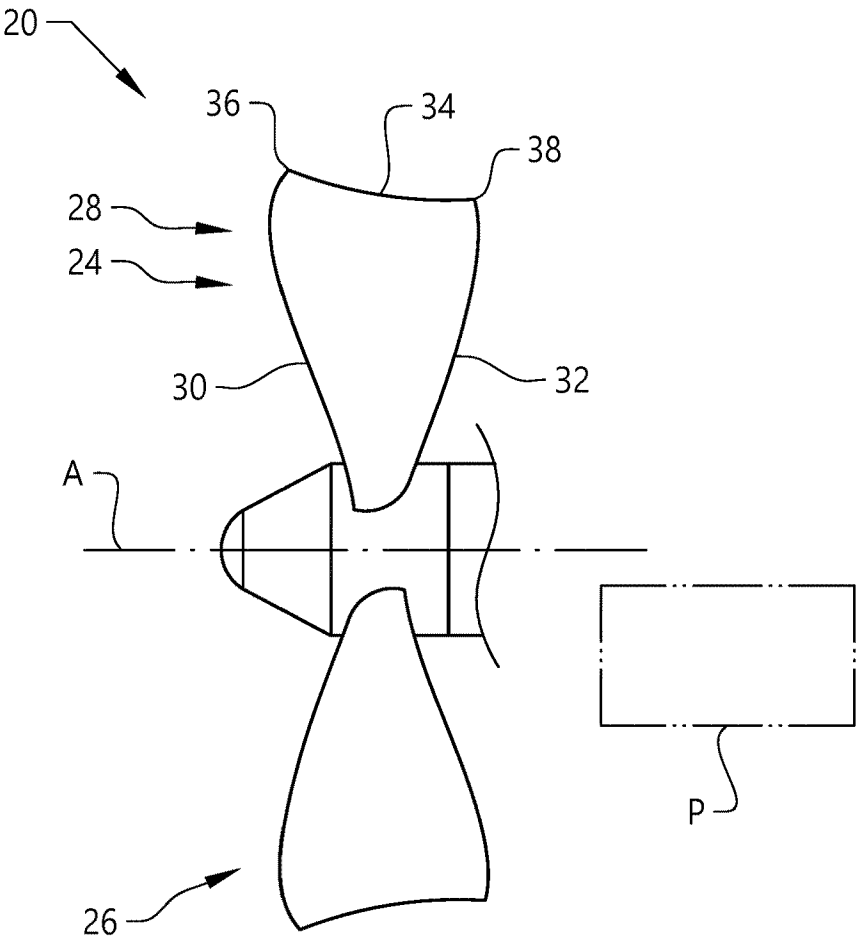
FIG. 3 is a schematic illustration of another embodiment of a propeller.

Moreover, as indicated in FIG. 2, as seen in a side plane view of the propeller blade 24 in a plane P that extends parallel to the axis of rotation A, a straight line from the first transition point 36 to the second transition point 38 coincides with the outer edge 34 or is located at least partially outside the propeller blade 24. In the FIG. 2 embodiment of the propeller 20, the outer edge 34 follows a substantially straight line. This means that when the outer edge follows the straight line this would result in that the outer edge follows a section of an envelope of an imaginary cone when the propeller rotates. FIG. 3 illustrates another embodiment of the propeller wherein the outer edge 24 has a parabolic shape, as seen in the plane P that extends parallel to the axis of rotation A.

Furthermore, a smallest distance $D_2$ from the second transition point 38 to the axis of rotation A is smaller than a smallest distance $D_1$ from the first transition point 36 to the axis of rotation A. As indicated in FIG. 2, the smallest distances may be the distance from the axis of rotation A to the first transition point 36 and the second transition point 38, respectively, in a direction being parallel to a radial axis R.

Each of the transition points 36, 38 is arranged at ends of the outer edge 34 where the extension of the outer edge does not coincide with the straight line and where the edge bends off towards said axis of rotation A, thus the edge now forming one of said leading edge 30 or said trailing edge 32, when seen in said plane P.

Furthermore, in the FIG. 2 embodiment, the first transition point 36 is the outermost point, as seen in a radial direction from the axis of rotation, of the propeller blade 24. Put differently, the smallest distance $D_1$ from the first transition point 36 to the axis of rotation A is larger than the smallest distance from any other point on the edge 28 of the propeller blade 24 to the axis of rotation A.

Further, the first and the second transition points are corners with a curvature radius smaller than 1/10 of a diameter of the propeller, or preferably smaller than 1/50 of a diameter of the propeller. Thus, two relatively sharp transition points are preferably arranged. This provides an outer edge that is clearly distinct from the leading edge and the trailing edge through respective first and second transition points. Arranging clear transition points will provide a more pure function according to the invention to the outer edge, which is to be able to reduce the risk of cavitation issues.

As a non-limiting example, as seen in the side plane view of the propeller blade, the length $L_1$ of the outer edge 34 along the axis of rotation A may be equal to or greater than 5%, preferably equal to or greater than 20%, of the maximum length $L_{tot}$ of the propeller blade 24 along the axis of rotation A.

Furthermore, though purely by way of example, as seen in the side plane view of the propeller blade, the length $L_1$ of the outer edge 34 along the axis of rotation A is equal to or less than 50%, preferably equal to or less than 40%, of the maximum length $L_{tot}$ of the propeller blade 24 along the axis of rotation A.

As another non-limiting example, the smallest distance $D_2$ from the second transition point 38 to the axis of rotation A may be equal to or less than 99% , preferably equal to or less than 95%, of the smallest distance $D_1$ from the first transition point 36 to the axis of rotation A.

Further, though purely by way of example, the smallest distance $D_2$ from the second transition point to the axis of rotation may be equal to or greater than 70%, preferably equal to or greater than 75%, of the smallest distance from the first transition point to the axis of rotation.

The ratio between the distances $D_1$, $D_2$ as well as the length $L_1$ of the outer edge 34 may be selected on the basis of a predicted slip stream shape generated by the propeller itself or by another component, such as another propeller, located upstream of the propeller. Purely by way of example, the distances $D_1$, $D_2$, and possibly also the length $L_1$ may be such that the outer edge 34 is within the predicted slip stream, thereby reducing the risk for cavitation associated disturbances, but close to the slip stream to thereby obtain a large propeller area.

Figure 4:
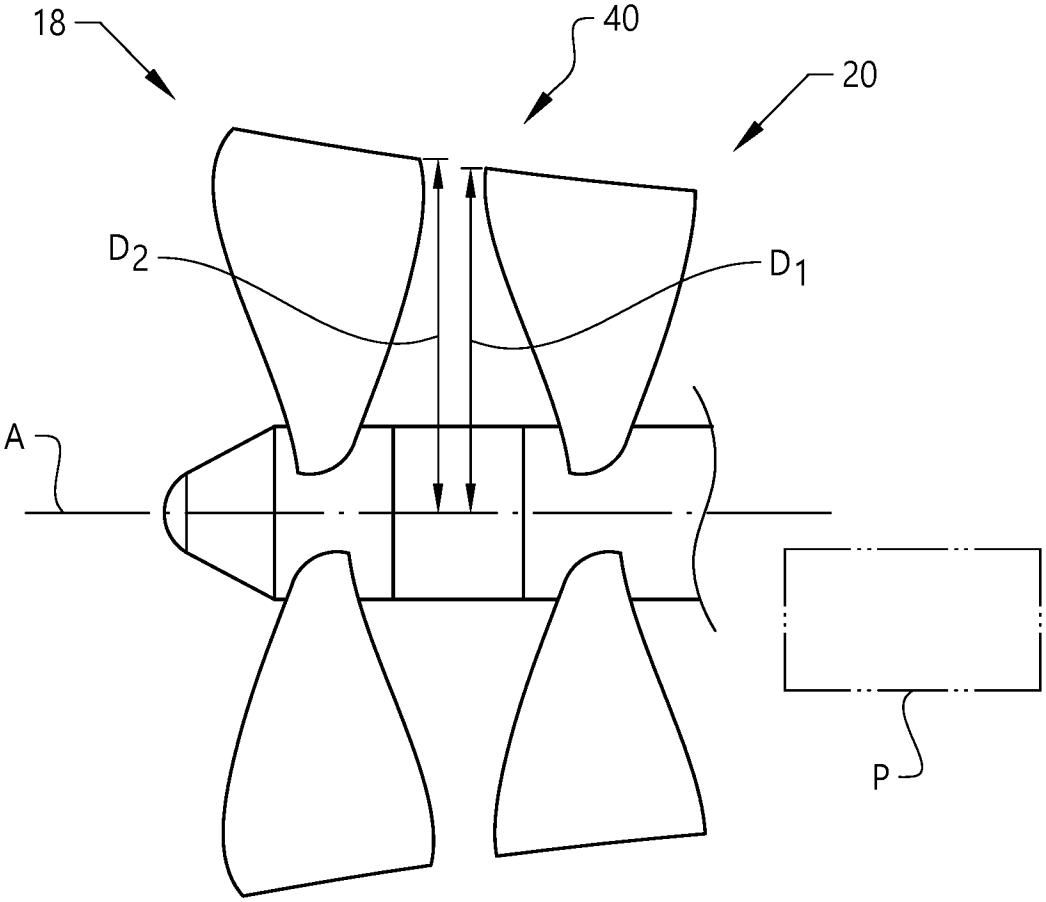
FIG. 4 is a schematic illustration of an embodiment of a propeller combination.

FIG. 4 illustrates an embodiment of a propeller combination 40 comprising a forward propeller 18 and an after propeller 20. The propellers 18, 20 are adapted to rotate in opposite directions around the axis of rotation A. At least one of the forward propeller 18 and the after propeller 20 is a propeller according to the first aspect of the present invention, for instance as exemplified above with reference to FIG. 2 or FIG. 3. In the FIG. 4 embodiment, each one of the forward propeller 18 and the after propeller 20 is a propeller according to the first aspect of the present invention.

Further, as indicated in the FIG. 4 embodiment, the smallest distance $D_1$ from the first transition point to the axis of rotation A for the after propeller 20 is smaller than a smallest distance from the second transition point $D_2$ to the axis of rotation A for the forward propeller 18.

It is to be understood that the present invention is not limited to the embodiments described above and illustrated in the drawings; rather, the skilled person will recognize that many changes and modifications may be made within the scope of the appended claims.

The invention claimed is:

1. A propeller combination comprising a forward propeller and an after propeller, said propellers being adapted to rotate in opposite directions around an axis of rotation, wherein each one of said forward propeller and said after propeller is a propeller according to the following:

a propeller for a marine vessel, said propeller comprising a plurality of propeller blades, said propeller being adapted to be rotated around said axis of rotation, each one of said propeller blades comprising an edge that in turn comprises a leading edge, a trailing edge and an outer edge located between said leading edge and said trailing edge, as seen along said edge of said propeller blade, wherein a transition from said leading edge to said outer edge occurs at a first transition point and a transition from said outer edge to said trailing edge occurs at a second transition point, wherein as seen in a side plane view of said propeller blade in a plane that extends parallel to said axis of rotation, a straight line from said first transition point to said second transition point coincides with said outer edge or is located at least partially outside said propeller blade, wherein a smallest distance from said second transition point to said axis of rotation is smaller than a smallest distance from said first transition point to said axis of rotation, wherein, as seen in said side plane view of said propeller blade, a length of said outer edge along said axis of rotation is equal to or greater than 20% of the maximum length of the propeller blade along said axis of rotation, where each of the transition points is arranged at ends of the outer edge where the extension of the outer edge does not coincide with the straight line and where the edge bends off towards said axis of rotation forming one of said leading edge or said trailing edge, when seen in said plane, wherein said smallest distance from said first transition point to said axis of rotation for said after propeller is smaller than a smallest distance from said second transition point to said axis of rotation (A) for said forward propeller.

2. The propeller according to claim 1, wherein said first transition point is the outermost point, as seen in a radial direction from said axis of rotation, of said propeller blade.

3. The propeller according to claim 1, wherein the first and the second transition points are corners with a curvature radius smaller than 1/10 of a diameter of the propeller, or smaller than 1/50 of a diameter of the propeller.

4. The propeller according to claim 1, wherein, as seen in said side plane view of said propeller blade, the length of said outer edge along said axis of rotation is equal to or less than 50% of the maximum length of the propeller blade along said axis of rotation.

5. The propeller according to claim 4, wherein, as seen in said side plane view of said propeller blade, the length of said outer edge along said axis of rotation is equal to or less than 40% of the maximum length of the propeller blade along said axis of rotation.

6. The propeller according to claim 1, wherein said smallest distance from said second transition point to said axis of rotation is equal to or less than 99% of said smallest distance from said first transition point to said axis of rotation.

7. The propeller according to claim 6, wherein said smallest distance from said second transition point to said axis of rotation is equal to or less than 95% of said smallest distance from said first transition point to said axis of rotation.

8. The propeller according to claim 1, wherein said smallest distance from said second transition point to said axis of rotation is equal to or greater than 70% of said smallest distance from said first transition point to said axis of rotation.

9. The propeller according to claim 8, wherein said smallest distance from said second transition point to said axis of rotation is equal to or greater than 75% of said smallest distance from said first transition point to said axis of rotation.

10. A marine vessel comprising a propeller combination according to claim 1.

* * * * *